US008096774B2

(12) United States Patent
Frankenstein et al.

(10) Patent No.: US 8,096,774 B2
(45) Date of Patent: Jan. 17, 2012

(54) TURBOCHARGER

(75) Inventors: Dirk Frankenstein, Worms (DE); Markus Schwerdtieger, Mannheim (DE); Bruno Ferling, Bendersheim (DE)

(73) Assignees: BorgWarner Inc., Auburn Hills, MI (US); KACO GmbH + Co. KG, Talheim (DE)

( * ) Notice: Subject to any disclaimer, the term of this patent is extended or adjusted under 35 U.S.C. 154(b) by 810 days.

(21) Appl. No.: 12/091,123

(22) PCT Filed: May 23, 2006

(86) PCT No.: PCT/EP2006/004908

§ 371 (c)(1),
(2), (4) Date: Aug. 29, 2008

(87) PCT Pub. No.: WO2007/048451

PCT Pub. Date: May 3, 2007

(65) Prior Publication Data

US 2008/0317596 A1 Dec. 25, 2008

(30) Foreign Application Priority Data

Oct. 24, 2005 (EP) ..... 05023173

(51) Int. Cl.
*F04D 29/12* (2006.01)

(52) U.S. Cl. ..... 416/174; 415/111; 415/113; 415/230; 415/231

(58) Field of Classification Search ..... 415/111, 415/113, 230; 416/174; 277/367, 369, 422
See application file for complete search history.

(56) References Cited

U.S. PATENT DOCUMENTS

| | | | | |
|---|---|---|---|---|
| 4,196,910 | A * | 4/1980 | Aizu | 277/419 |
| 4,268,229 | A * | 5/1981 | Berg | 417/407 |
| 4,389,052 | A * | 6/1983 | Shimizu et al. | 277/346 |
| 4,502,693 | A | 3/1985 | Lesiecki et al. | |
| 4,986,733 | A | 1/1991 | Fleury et al. | |
| 5,129,782 | A * | 7/1992 | Ruetz | 415/111 |
| 5,890,881 | A * | 4/1999 | Adeff | 417/407 |
| 7,086,842 | B2 * | 8/2006 | Wild | 417/407 |
| 2001/0036403 | A1 * | 11/2001 | Heyes | 415/174.5 |
| 2002/0141862 | A1 * | 10/2002 | McEwen | 415/111 |

FOREIGN PATENT DOCUMENTS

| | | |
|---|---|---|
| FR | 2503478 A | 10/1982 |
| GB | 1210388 A | 10/1970 |

* cited by examiner

*Primary Examiner* — Stephen W Smoot
(74) *Attorney, Agent, or Firm* — William Anderson; Stephan A. Pendorf; Patent Central LLC

(57) ABSTRACT

The invention relates to a turbocharger (15) comprising a bearing housing (7) which mounts a rotor shaft (12) and has a bearing-housing oil space (13); comprising a compressor housing which is connected to the bearing housing (7) and has a compressor space (14); and comprising a sealing device (20) which is provided for sealing the bearing-housing oil space (13) relative to the compressor space (14) and which has a sealing ring (1) which is arranged in a fixed position in the bearing housing (7) and has two end faces (17, 17') which interact with associated end faces (10) and (11) of a disc (9) and a sealing bush (16) which are fastened to the rotor shaft (12), wherein the sealing ring (1) is arranged with axial play on the rotor shaft (12) between the disc (9) and the sealing bush (16); and air-delivery devices (2, 3) oriented in opposition are arranged in the end faces (17, 17') of the sealing ring (1).

10 Claims, 2 Drawing Sheets

TURBOCHARGER

CROSS-REFERENCE TO RELATED APPLICATIONS

This application is a §371 national stage entry of International Application No. PCT/EP2006/004908, filed May 23, 2006, which claims priority to EP Application No. 05023173.7, filed Oct. 24, 2005, the disclosures of which are both hereby incorporated by reference.

BACKGROUND OF THE INVENTION

1. Field of the Invention

The invention relates to a turbocharger with a sealing device which has a sealing ring for sealing the bearing housing oil space with respect to the compressor space.

2. Description of the Related Art

A turbocharger of this type is known, for example, from U.S. Pat. No. 4,420,160.

This turbocharger has a sealing device for sealing a bearing housing oil space with respect to a compressor space, which sealing device is provided with a sealing ring which is mounted in a fixed position in the bearing housing. The sealing ring has sealing end faces which bear against rotating counter-faces to produce the sealing effect. Because the production of a sealing effect therefore necessitates a mechanical abutment between the end faces of the sealing ring and the opposite counter-faces rotating with the compressor shaft, mechanical wear and therefore deterioration of the sealing effect is unavoidable, at least after a certain running time of the turbocharger.

BRIEF SUMMARY OF THE INVENTION

It is therefore the object of the present invention to create a turbocharger which is provided with a sealing device which makes possible a longer service life as a result of at least significantly reduced wear of the sealing faces, and therefore a better sealing effect.

This object is achieved by the sealing device according to the invention.

The turbocharger according to the invention has, specifically, a sealing device which has a sealing ring for sealing the bearing housing oil space with respect to the compressor space. This sealing ring is arranged in the bearing housing and is provided with two end faces which are provided with associated end faces of a disk on one side and of a sealing bush on another side in order to produce the sealing effect, the disk and the sealing bush being fixed to the rotor shaft.

Because the sealing ring is arranged on the rotor shaft with axial play between the disk and the sealing bush, during assembly the sealing ring usually abuts against one of the two end faces (that is, either the end face of the disk or that of the sealing bush). During operation of the turbocharger, the sealing ring is released from the abutment position and forms, depending on the existing pressure difference between compressor side and bearing housing side, a delivery gap with the respective associated end face. Primarily as a result of the delivery device which forms the delivery gap with the respective associated end face of the sealing ring, an air flow is produced which leads to the formation of air cushions between each of the non-rotating, fixed end faces of the sealing ring and the associated rotating end faces of the disk and the sealing sleeve. This air flow prevents, firstly, flow of oil from the bearing housing in the direction of the compressor and, secondly, direct mechanical contact between the end faces producing the seal, which at least considerably reduces wear on the turbocharger according to the invention.

The air flow mentioned is produced by the delivery devices or delivery structures arranged in the two end faces of the sealing ring, which are oppositely oriented, meaning that, essentially, either the compressor-side delivery device delivers air from the outer circumference to the inner circumference, or the bearing housing-side delivery device effects a delivery of air from the inner circumference to the outer circumference. This means, specifically, that, with a diminishing gap, the compressor-side delivery device pumps the air from the compressor housing from radially outside to radially inside, or, with a diminishing gap, the bearing housing-side delivery device conducts the air from inside to radially outside. In both cases the air is conducted into an axial gap between the inner circumference of the sealing ring and the sealing bush and can thus reach the bearing housing side from the compressor side. This gives rise to an approximately U-shaped, forced air flow which, as stated, produces the sealing effect and prevents mechanical abutment between the opposite fixed and rotating end faces.

Advantageous developments of the turbocharger according to the invention are set forth in the claims.

In accordance with one embodiment of the invention, the inventive sealing device is an object which can be sold independently.

BRIEF DESCRIPTION OF THE SEVERAL VIEWS OF THE DRAWINGS

Further details, features and advantages of the invention are apparent from the following description of exemplary embodiments with reference to the drawing, in which.

DETAILED DESCRIPTION OF THE INVENTION

Figure 1:
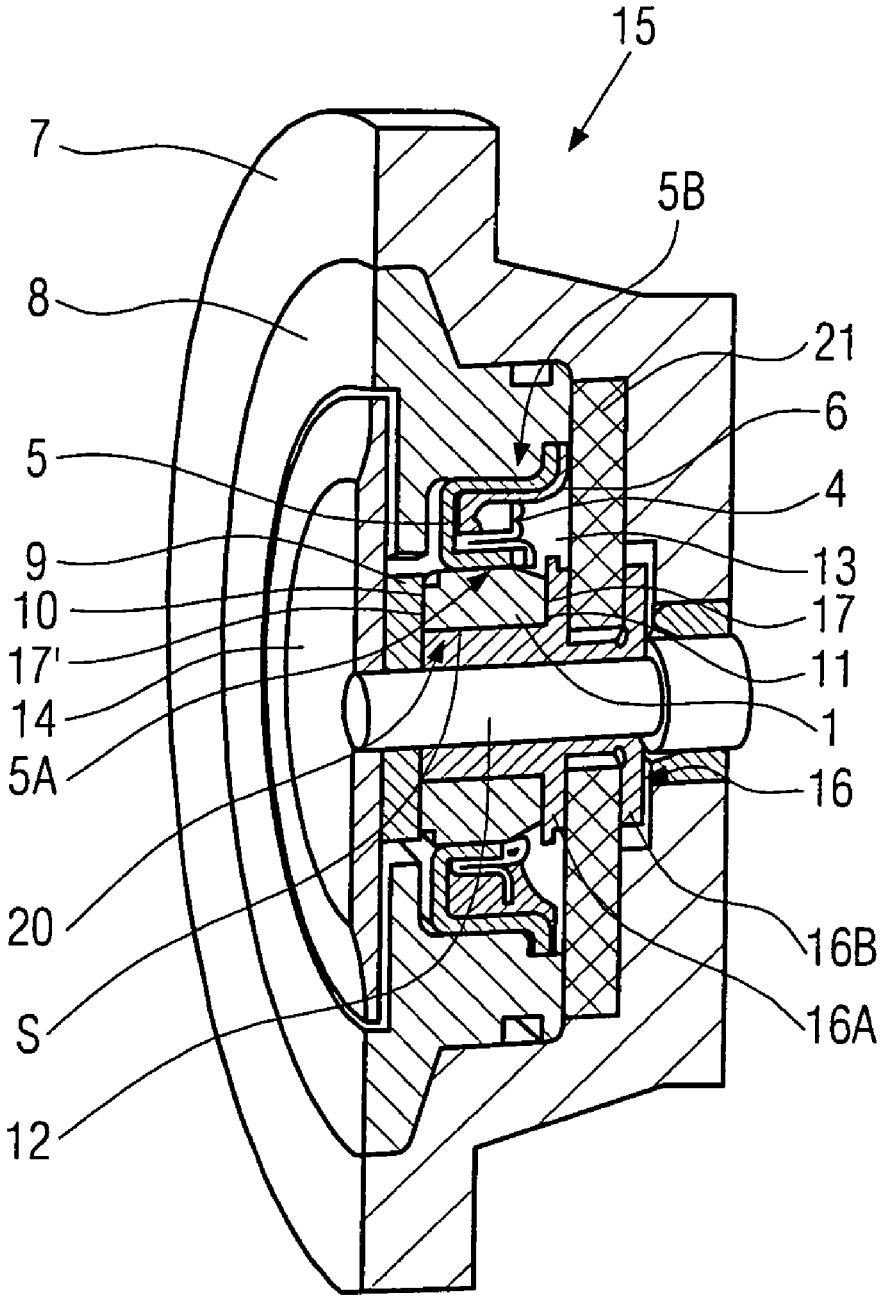
FIG. 1 is a schematically simplified representation of a turbocharger according to the invention.

FIG. 1 shows a part of a turbocharger 15 according to the invention, which has a bearing housing 7 in which a rotor shaft 12 is mounted and which is connected to a compressor housing, of which only the compressor space 14 is visible. Of course, the turbocharger also has, as usual, a turbine with a turbine housing, which, however, like the complete compressor side, is not represented in FIG. 1, as these parts are not necessary for an explanation of the present invention.

FIG. 1 also shows a sealing device which is designated as a whole by reference numeral 20. The sealing device 20 serves to seal a bearing housing oil space 13 with respect to the compressor space 14 of the compressor housing (not shown in detail) of the turbocharger 15.

The sealing device 20 has for this purpose a sealing ring 1 which is arranged in a fixed, i.e. non-rotating, manner in the bearing housing 7, and two end faces 17 and 17'. These end faces 17 and 17' cooperate respectively with end faces 10 and 11 of a disk 9 or of a sealing bush 16 to produce the sealing effect of the sealing device 20. FIG. 1 shows clearly that the disk 9 is arranged adjacent to the compressor space 14 and that the sealing bush 16 has two flanges 16A and 16B which, according to the view selected in FIG. 1, are arranged to the right of the sealing ring 1 in a spaced relationship to one another.

The flanges 16A and 16B guide an axial bearing 21. The flange 16A also delimits, together with the disk 9, a groove in which the sealing ring 1 is inserted with axial play, that is, with play in the longitudinal direction of the rotor shaft 12.

Within the groove delimited by the disk 9 and the flange 16A, the sealing ring 1 is likewise inserted with a radial play S forming an annular gap.

Figure 2:
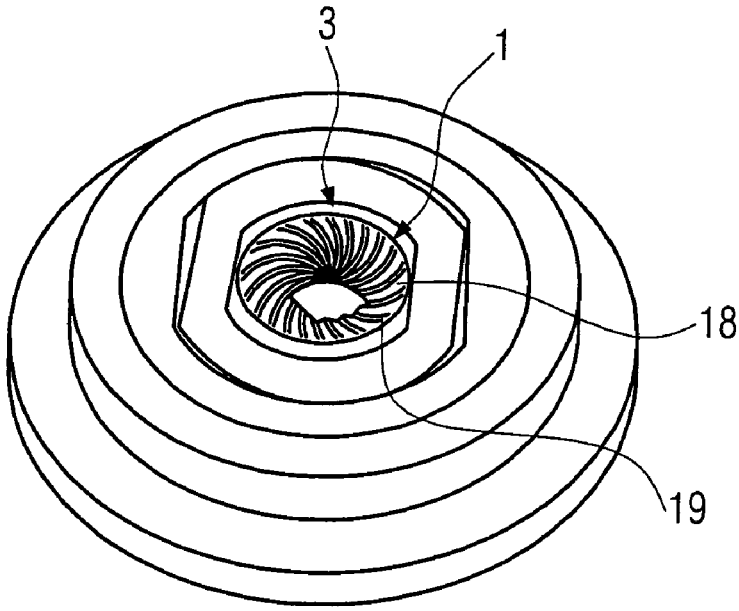
FIG. 2 is a top view of the sealing ring, viewed from the bearing housing side.
Figure 3:
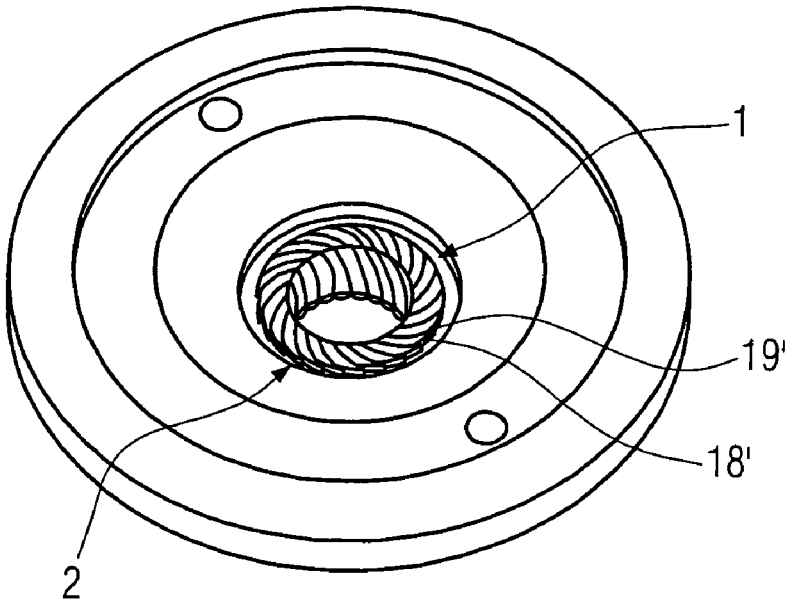
FIG. 3 is a representation, corresponding to FIG. 2, of the sealing ring of the inventive sealing device, viewed from the compressor side.

Delivery devices 2 and 3 are arranged respectively in the end faces 17 and 17' of the sealing ring 1, the delivery device 2 being on the compressor side while the delivery device 3 is arranged on the bearing housing side 3. These delivery devices can be seen in FIGS. 2 and 3. In the present example they are formed by grooves 19 and 19' bordered by respective ridges 18 and 18', which grooves 19 and 19' are oppositely oriented, meaning that the compressor-side delivery device 2 delivers air from the outer circumference to the inner circumference, while the bearing housing-side delivery device 3 delivers air from the inner circumference to the outer circumference.

To this end the sealing ring 1 is mounted in a floating manner in the bearing housing 7. In the especially preferred embodiment shown in FIG. 1, the sealing ring 1 is connected to an end region 5A of an elastomer molding 5, the other end region 5B of which is fixed in the bearing housing 7.

The connection between the sealing ring and the end region 5A may be positive, nonpositive or frictional. A combination of these types of connection is also possible.

FIG. 1 also makes clear that the end region 5A is pressed against the sealing ring 1 by a first retaining ring 4.

The other end region 5B of the elastomer molding 5 is fixed by a second retaining ring 6 in a bore of the bearing housing 7 or in an additional part 8 which represents a kind of cover with which the opening of the bearing housing 7 can be closed, as can be seen in detail from the graphic representation in FIG. 1.

The sealing device 20 explained above seals the bearing housing oil space 13 with respect to the compressor space 14. The sealing function is hereby performed by the sealing ring 1, which is arranged between the concurrently rotating end faces 10 and 11 of the disk 9 and of the annular flange 16A respectively. During assembly the sealing ring 1 usually rests against one of the two said end faces 10 and 11. During operation of the turbocharger, depending on the pressure difference between the compressor and bearing housing sides, an air cushion is built up between the fixed end face 17 of the sealing ring 1 and the rotating end face 11 by the flow generated in the delivery gap by the relevant delivery device 2 or 3, or the air cushion is formed by the feed effect between the fixed end face 17' and the rotating end face 10. The delivery devices or delivery structures 2 and 3 produce an air flow in the direction of the bearing housing oil space 13, which prevents oil from flowing out of the bearing housing 7 in the direction of the compressor.

Stated more precisely, the delivery device 2 generates an air flow from the compressor housing 7 from radially outside to radially inside. The air is then conducted into the axial gap S and guided from inside to outside in the region of the annular flange 16*a*, so that a forced airflow which is approximately U-shaped is produced.

As explained previously, egress of oil in the direction of the compressor is thereby prevented and, in addition, a mechanical abutment of the fixed end faces 17 and 17' of the sealing ring 1 against the opposite, rotating sealing faces of the rotor shaft assembly formed by the rotor shaft 12, the disk 9 and the sealing bush 16 is avoided.

The retaining ring 4 which presses the elastomer molding 5 against the sealing ring 1 may additionally be used, by appropriate configuration (recesses, tongues, cams, etc.), for positive torque-transmission between the sealing ring 1 and the bearing housing 7.

LIST OF REFERENCES LIST OF REFERENCE NUMBERS

1 Sealing ring
2, 3 Delivery devices/delivery structures
4 First retaining ring
5 Elastomer molding
5A, 5B End regions
6 Second retaining ring
7 Bearing housing
8 Additional part/cover
9 Disk
10, 11 Concurrently rotating end faces
12 Rotor shaft/rotor assembly
13 Bearing housing oil space
14 Compressor space
15 Part of a turbocharger
16 Sealing bush
16A, 16B Flanges
17, 17' End faces of 1
18, 18' Ridges/air guidance ridges
19, 19' Grooves/air guidance grooves
20 Sealing device
S Play between 1 and 16

The invention claimed is:

1. A sealing device (20) for a turbocharger (15) which comprises a bearing housing (7), a rotor shaft (12) mounted in the bearing housing (7), a bearing housing oil space (13) located in the bearing housing (7) and a compressor housing with a compressor space (14), the sealing device (20) having a sealing ring (1) with two end faces (17, 17'), wherein the sealing ring (1) has oppositely-oriented air delivery devices (2, 3) in or on the end faces (17, 17'), and in that the sealing ring (1) can be positioned with axial play on the rotor shaft (12) of the turbocharger (15) between a disk (9) and a sealing bush (16) of the turbocharger (15).

2. A turbocharger (15), comprising:

a bearing housing (7) in which a rotor shaft (12) is mounted and which has a bearing housing oil space (13);

a compressor housing which is connected to the bearing housing (7) and has a compressor space (14); and a sealing device (20) provided in order to seal the bearing housing oil space (13) with respect to the compressor space (14), which sealing device (20) has a sealing ring (1) which is arranged in the bearing housing (7) and has two end faces (17, 17') which cooperate with respective associated end faces (10, 11) of a disk (9) and of a sealing bush (16), which are fixed to the rotor shaft (12), wherein the sealing ring (1) is arranged with axial play on the rotor shaft (12) between the disk (9) and the sealing bush (16), and in that oppositely-oriented air delivery devices (2, 3) are arranged in or on the end faces (17, 17') of the sealing ring (1).

3. The turbocharger of claim 2, wherein the disk (9) and the sealing bush (16) delimit a groove in which the sealing ring (1) is arranged.

4. The turbocharger of claim 2, wherein the sealing ring (1) is mounted in a floating manner in the bearing housing (7).

5. The turbocharger of claim 4, wherein the sealing ring (1) is connected to an end region (5A) of an elastomer molding (5) which can be fixed by its other end region (5B) in the bearing housing (7).

6. The turbocharger of claim 5, wherein the sealing ring (1) is connected to the one end region (5A) of the elastomer molding (5) in a positive, nonpositive and frictional manner or by a combination of these types of connection.

7. The turbocharger of claim 5, wherein the one end region (5A) is pressed against the sealing ring (1) by a first retaining ring (4).

8. The turbocharger of claim 5, wherein the other end region (5B) can be fixed by a second retaining ring (6) in a bore of the bearing housing (7) or in an additional part (8) of the bearing housing (7).

9. The turbocharger of claim 2, wherein the delivery devices (2, 3) are in the form of grooves (19, 19') in or on the end faces (17, 17') of the sealing ring (1).

10. The turbocharger of claim 9, wherein the grooves (19, 19') are bordered by air guidance ridges (18, 18') arranged on the end faces (17, 17') of the sealing ring (1).

* * * * *

UNITED STATES PATENT AND TRADEMARK OFFICE

CERTIFICATE OF CORRECTION

PATENT NO. : 8,096,774 B2
APPLICATION NO. : 12/091123
DATED : January 17, 2012
INVENTOR(S) : Dirk Frankenstein et al.

It is certified that error appears in the above-identified patent and that said Letters Patent is hereby corrected as shown below:

On the Title Page, item [75]; the second inventor's name Markus Schwerdtieger should read -- Markus Schwerdtfeger --

Signed and Sealed this
Twenty-sixth Day of June, 2012

David J. Kappos

David J. Kappos
*Director of the United States Patent and Trademark Office*